US005975518A

United States Patent [19]

Wakana et al.

[11] Patent Number: 5,975,518

[45] Date of Patent: Nov. 2, 1999

[54] PAPER FEEDING MECHANISM

[75] Inventors: Takashi Wakana; Shigeki Nakajima, both of Tokyo, Japan

[73] Assignee: Oki Data Corporation, Tokyo, Japan

[21] Appl. No.: 08/938,558

[22] Filed: Sep. 26, 1997

[30] Foreign Application Priority Data

Sep. 30, 1996 [JP] Japan ..... 8-258956

[51] Int. Cl.[6] ..... B65H 3/52

[52] U.S. Cl. ..... 271/121; 271/117

[58] Field of Search ..... 271/117, 121, 271/124

[56] References Cited

U.S. PATENT DOCUMENTS

| | | | |
|---|---|---|---|
| 5,163,668 | 11/1992 | Winship et al. | 271/124 X |
| 5,372,359 | 12/1994 | Miura et al. | 271/121 X |
| 5,528,352 | 6/1996 | Ichinokawa et al. | 271/121 X |
| 5,727,782 | 3/1998 | Okada | 271/121 |
| 5,823,524 | 10/1998 | Kawada | 271/121 X |

FOREIGN PATENT DOCUMENTS 35-4005 3/1960 Japan .

4-1845 1/1992 Japan .

*Primary Examiner*—William E. Terrell
*Assistant Examiner*—Gene O. Crawford
*Attorney, Agent, or Firm*—Rabin & Champagne PC

[57] ABSTRACT

A paper feeding mechanism holds a stack of print paper in pressure contact with a paper pick-up roller. The paper pick-up roller feeds the print paper out of the tray one page at a time when the paper pick-up roller is rotated. The paper feeding mechanism has first and second supporting surfaces. The first supporting surface holds the stack of print paper from behind a back surface of the print paper. The first supporting surface is at a second angle θ 2 with the horizontal direction such that the print paper slides along the first supporting surface to the second supporting surface with the aid of the gravity of the print paper. The second supporting surface supports the stack of print paper thereon. The second supporting surface is inclined at a first angle θ 1 with a horizontal direction such that a leading edge of each page of the print paper abuts the second supporting surface and slides toward the rotating paper pick-up roller with the aid of a gravity of the print paper.

9 Claims, 8 Drawing Sheets

PAPER FEEDING MECHANISM

BACKGROUND OF THE INVENTION

1. Field of Invention

The present invention relates to a paper feeding mechanism for use in a printer or the like, and more particularly to a mechanism which feeds print paper, sheet by sheet.

2. Description of Related Art

Conventional printers use a paper feeding mechanism in which a plurality of pages of print paper is held in a tray and in pressure contact with the paper pick-up roller. A frictional force is developed between the paper pick-up roller and print paper in pressure contact with the paper pick-up roller. The frictional force permits the print paper to be fed out of the tray when the paper pick-up roller, is rotated. The print paper is usually held in pressure contact with the aid of an exclusive spring or the like which urges the bottom plate toward the paper pick-up roller. When the tray becomes empty, the bottom plate moves into direct contact with the paper pick-up roller. Therefore, a bottom plate of the tray must be moved away from the paper pick-up roller against the urging force of the spring when print paper is again loaded in the tray. The bottom plate is moved away from the tray using an exclusive lever provided in the printer.

As mentioned above, the conventional paper feeding mechanisms are disadvantageous in that the setting lever must be operated prior to loading print paper into the tray. This is time consuming. Providing an exclusive setting lever increases the number of parts and is detrimental to miniaturization and cost reduction of the paper feeding mechanism.

SUMMARY OF THE INVENTION

An object of the invention is to provide a paper feeding mechanism in which a stack of paper can be loaded without a paper setting lever.

A stack of print paper is in pressure contact with a paper pick-up roller and the paper pick-up roller feeds the print paper out of the tray one page at a time when the paper pick-up roller is rotated.

A first surface supports the stack of print paper from behind a back surface of the print paper. The first surface is at a first angle θ 2 with the horizontal plane so that the print paper slides down along the first surface due to gravity acting on the print paper.

A second surface supports the lower end of the print paper thereon which slides down along the first surface. The second surface is at a second angle θ 1, θ 3, and θ 4 with the horizontal plane such that a force, resulting from gravity acting on the print paper; and is large enough to move the print paper toward the paper pick-up roller, the page of print paper sliding up along the second surface into contact with the paper pick-up roller.

Further scope of applicability of the present invention will become apparent from the detailed description given hereinafter. However, it should be understood that the detailed description and specific examples, while indicating preferred embodiments of the invention, are given by way of illustration only, since various invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Preferred embodiments of the present invention will be described with reference to the drawings.

First Embodiment

Figure 1:
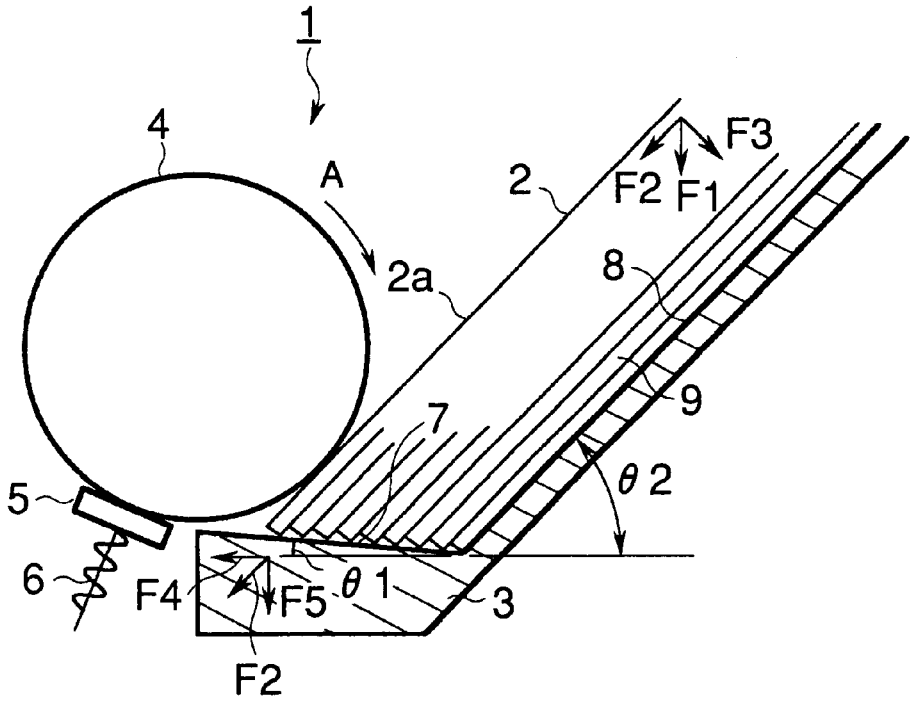
FIG. 1 is a partially cross-sectional side view of a paper feeding mechanism according to a first embodiment.

FIG. 1 is a partially cross-sectional side view of a paper feeding mechanism according to a first embodiment. Referring to FIG. 1, a paper feeding mechanism 1 includes a tray 3 which holds print paper 2 and a paper pick-up roller 4 which feeds the print paper out of the tray 3. The paper pick-up roller 4 rotates in a direction shown by arrow A, and is in pressure contact with a separator 5 which is urged by a compression spring 6. The surfaces of the paper pick-up roller 4 and the separator 5 that are in contact with each other are formed of a highly frictional material so that a, large frictional force is developed between the surfaces, and the print paper 2 when the print paper is fed out of the tray 3.

The tray 3 has a bottom surface 7 on which the print paper obliquely stands, and a back surface 8 on which the print paper 2 is supported from the back surface of the paper. The bottom surface 7 is at an angle of θ 1 with a horizontal, the angle θ 1 being, for example, 20 degrees. The angle θ 1 is such that a force, resulting from gravity acting on the print paper 2, is large enough to move the print paper 2 toward the paper pick-up roller 4. The back surface 8 is at an angle θ 2 with the horizontal, so that the paper 2 slides down with the aid of its weight. The angle θ 2 is for example, 36 degrees. A space defined by the bottom surface 7 and back surface 8 is a paper feeding area 9.

The paper feeding operation of the first embodiment will now be described.

The print paper 2 is loaded into the paper feeding area 9 without using a conventional setting lever. The print paper 2 is simply supplied into the tray 3 so that the print paper 2 slides down into the paper feeding area 9. This completes the paper loading operation. The print paper 2 introduced into the paper feeding area 9 slides on the bottom surface 7 toward the paper pick-up roller 4 till it abuts the paper pick-up roller 4. The weight F1 of the print paper 2 acts downward and is resolved into a force F2 and a force F3. The force F2 is further resolved into a force F4 and a force F5. This force F4 causes the print paper 2 to move into pressure contact with the paper pick-up roller 4.

Figure 2:
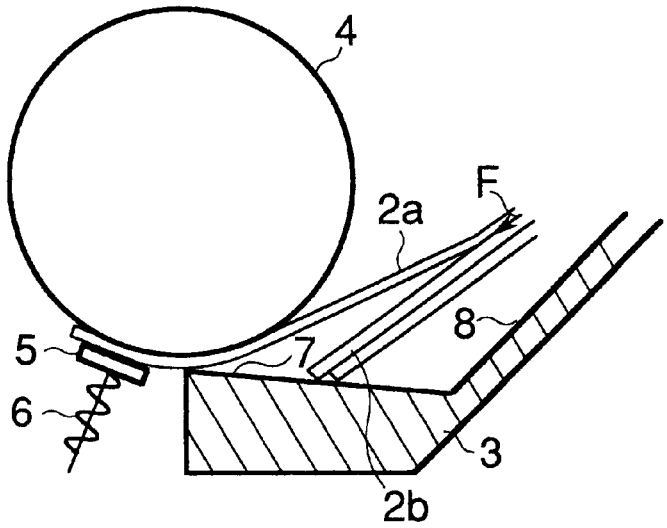
FIG. 2 is a partially cross-sectional side view showing a small number of pages loaded into the paper feeding area 9.

When the paper pick-up roller 4 is rotated, the frictional force between the paper pick-up roller 4 and the page 2*a* causes the page 2*a* to advance leftward in FIG. 2. The page 2*a* passes between the paper pick-up roller 4 and the separator 5 and travels further. If more than one page is fed out of the tray 3 at a time, then they move between the paper pick-up roller 4 and the separator 5. Only one page on the top is separated from the rest and is further transported. The rest of pages remain between the paper pick-up roller 4 and separator 5.

The operation when a small number of pages of print paper is in the paper feeding area 9 will be described with reference to FIG. 2.

FIG. 2 is a partially cross-sectional side view showing a small number of pages loaded into the paper feeding area 9. A small number of pages is inserted into the paper feeding area 9 till the leading edges of the pages abut the paper pick-up roller 4. This ensures that friction is developed between the print paper 2 and the paper pick-up roller 4, and the paper feeding mechanism 1 is ready to feed the print paper 2.

Even if a sufficient number of pages is in the paper feeding area 9, the remaining number of pages in the area will be decreased to a small number of pages if a large number of pages is printed at a time. As the print paper 2 is fed page by page, a page 2*b* following the page 2*a* which is being fed by the paper pick-up roller 4 also moves toward the paper pick-up roller 4 due to a frictional force F existing between the pages 2*a* and 2*b*. This frictional force ensures that the pages are smoothly fed even when only a small number of pages is left in the paper feeding area 9.

Figure 3:
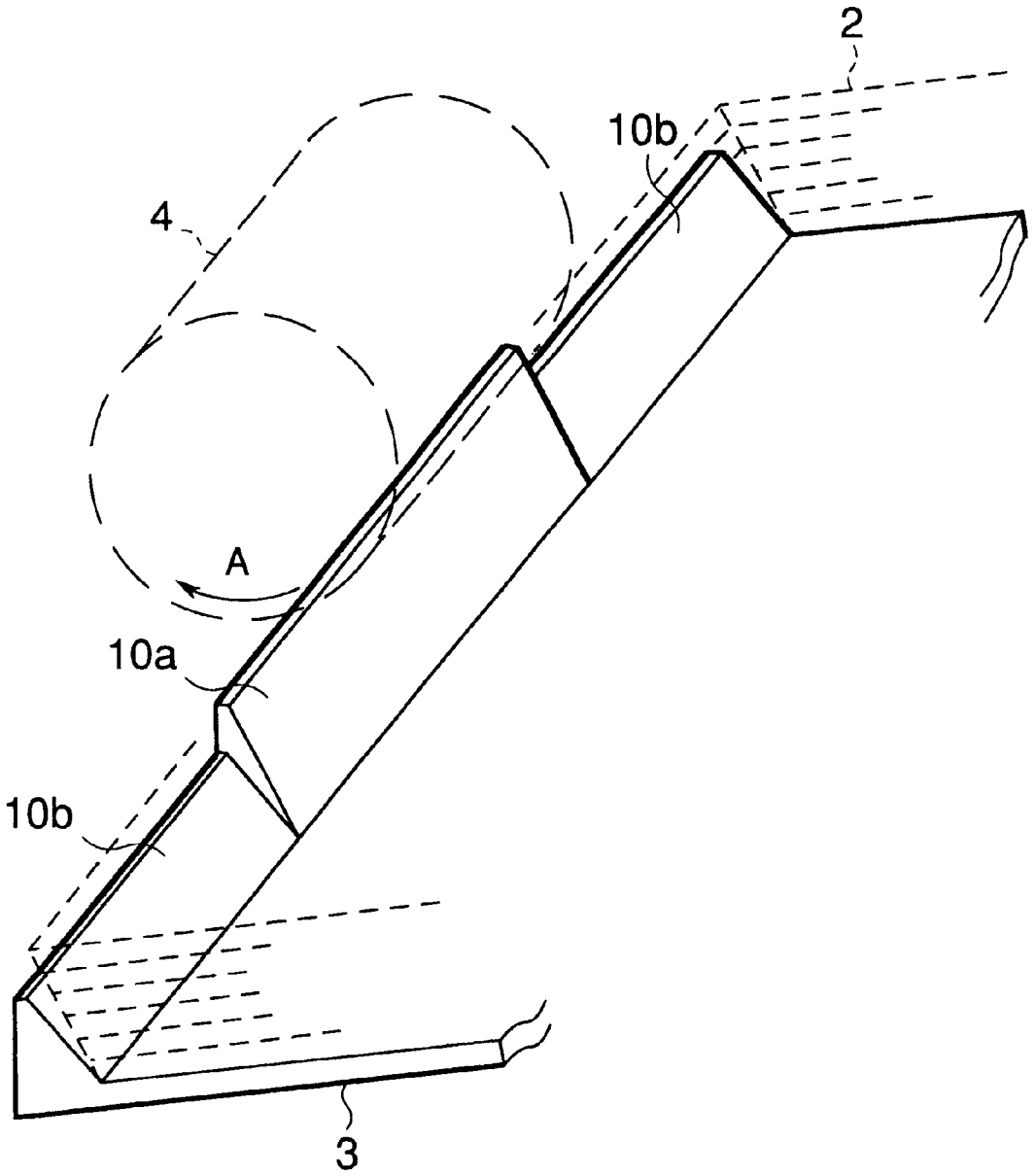
FIG. 3 is a perspective view of a modified bottom surface of the first embodiment.

The bottom surface 7 of the tray 3 may be modified to allow the print paper 2 to smoothly slide on the bottom surface 7. FIG. 3 is a perspective view of a modified bottom surface.

Referring to FIG. 3, the bottom includes a middle surface 10*a* between side surfaces 10*b*. The side surfaces 10*b* make larger angles with the back surface 8 than the middle surface 10*a*, so that the leading end of the print paper 2 is not in contact with the side surfaces 10*b*. Thus, the leading end of the print paper 2 is in contact with only the middle surface 10*a*. Therefore, the print paper 2 is subjected to less frictional force as the print paper 2 slides on the bottom surface 7, smoothly moving into contact with the paper pick-up roller 4. The combination of the surfaces 10*a* and 10*b* prevents the leading end of the print paper 2 from moving into contact with the side surfaces 10*b* before the middle portion of the print paper 2 moves into contact with the paper pick-up roller 4, if the leading end of the print paper 2 is permanently waved. This prevents a paper jam.

The bottom surface 7 may be made of a material having a friction coefficent so that the print paper 2 slides smoothly on the bottom surface 7. Such a material is, for example, polyacetal.

Second Embodiment

Figure 4:
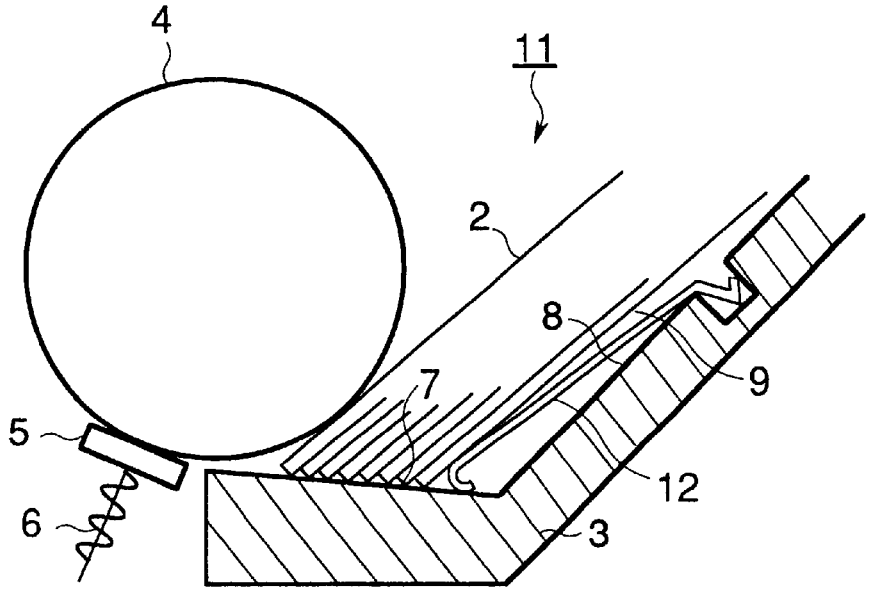
FIG. 4 is a partially cross-sectional side view of a paper feeding mechanism 11 according to a second embodiment.

FIG. 4 is a partial cross-sectional side view of a paper feeding mechanism 11 according to a second embodiment.

The first embodiment differs from the second embodiment in that the paper feeding area 9 is provided with a flat spring 12. The flat spring 12 serves to urge the print paper 2 stacked in the tray 3 against the paper pick-up roller 4 so that the top page of the print paper 2 is always in pressure contact with the paper pick-up roller 4.

The flat spring 12 is particularly useful if the print paper 2 is very lightweight so that the print paper 2 is not in sufficient pressure contact with the paper pick-up roller 4. The flat spring 12 adds pressure from behind the print paper 2, ensuring sufficient friction between the print paper 2 and the paper pick-up roller 4 to prevent misfeeding of the print paper 2.

Third Embodiment

Figure 5:
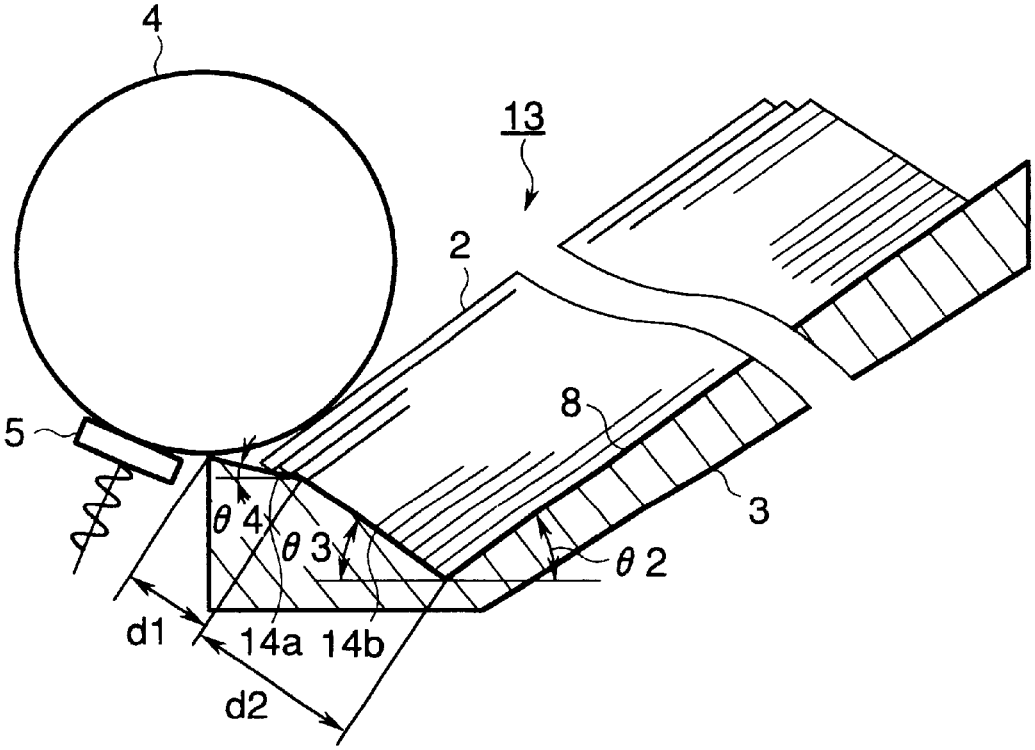
FIG. 5 is a partially cross-sectional side view of a paper feeding mechanism 13 according to a third embodiment.

FIG. 5 is a partially cross-sectional side view of a paper feeding mechanism 13 according to a third embodiment.

The third embodiment differs from the first embodiment in that the bottom surface 14 includes two surfaces 14*a* and 14*b*. The rest of the construction is the same as that of the first embodiment.

The surface 14*a* is at an angle θ 4 with the horizontal direction and the surface 14*b* is an angle θ 3. The back surface 8 makes an angle θ 2 with the horizontal direction. The angle θ 4 is, for example, 20 degrees. The angle θ 3 is larger than the angle θ 4 and is, for example, 32 degrees just enough for the leading end of the print paper 2 to slide to the paper pick-up roller 4 and for the upper edges of the pages of print paper 2 to be more even compared to the first embodiment. The angles θ 3 and θ 4 are such that a force resulting from the effects of gravity acting on the print paper 2 is large enough to move the print paper 2 toward the paper pick-up roller 4. The length of d1 of the surface 14*a* is selected so that the surface 14*a* can hold about ten pages of print paper 2, and the length d2 of the surface 14*b* is much longer than the length d1. Thus, the upper edges of the pages of the print paper 2 held on the surface 14*b* are substantially even, assuring the operator of proper loading of the print paper 2 into the tray 3.

Fourth Embodiment

Figure 6:
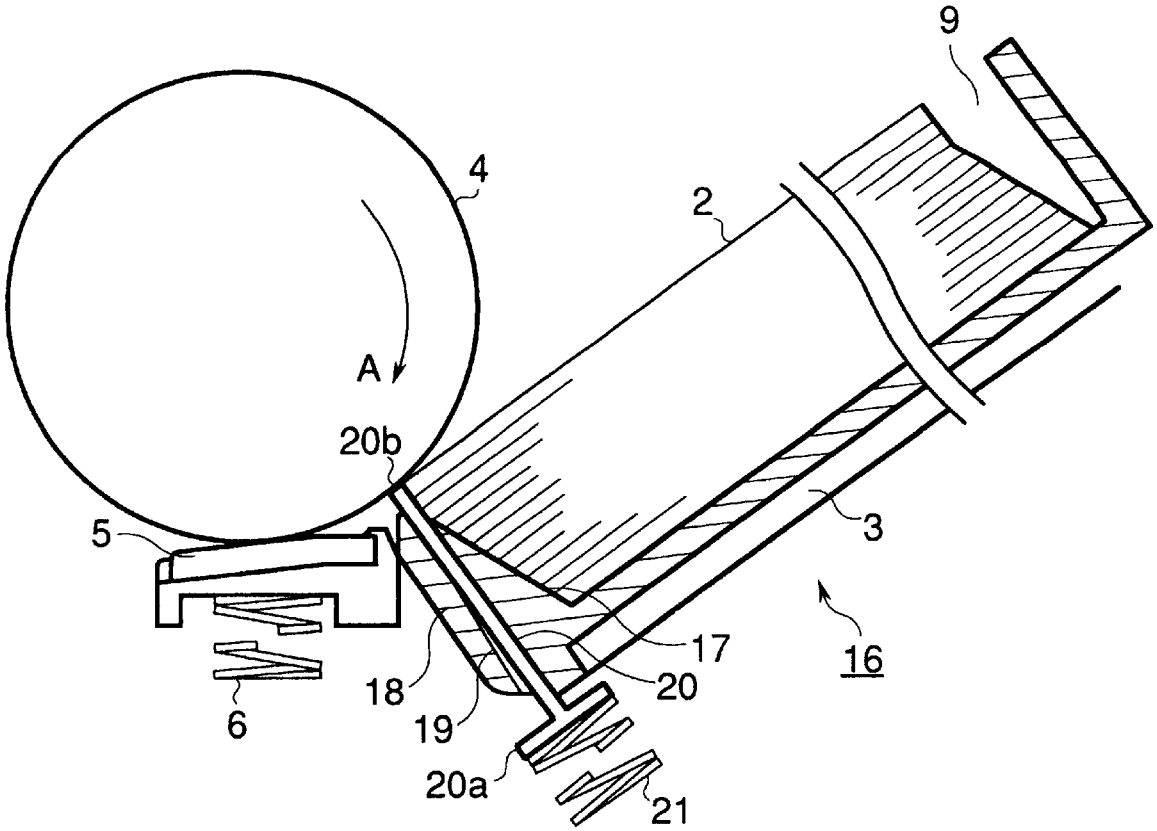
FIG. 6 is a partially cross-sectional side view of a paper feeding mechanism 16 according to a fourth embodiment.
Figure 7:
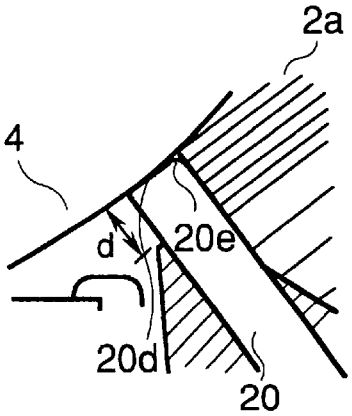
FIG. 7 is an enlarged partially cross-sectional side view illustrating the detail of the fourth embodiment.
Figure 8:
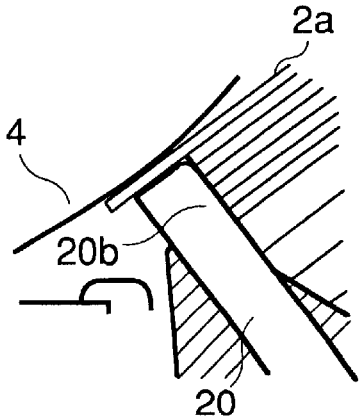
FIG. 8 is an expanded partially cross-sectional side view of a relevant portion of FIG. 6.
Figure 9:
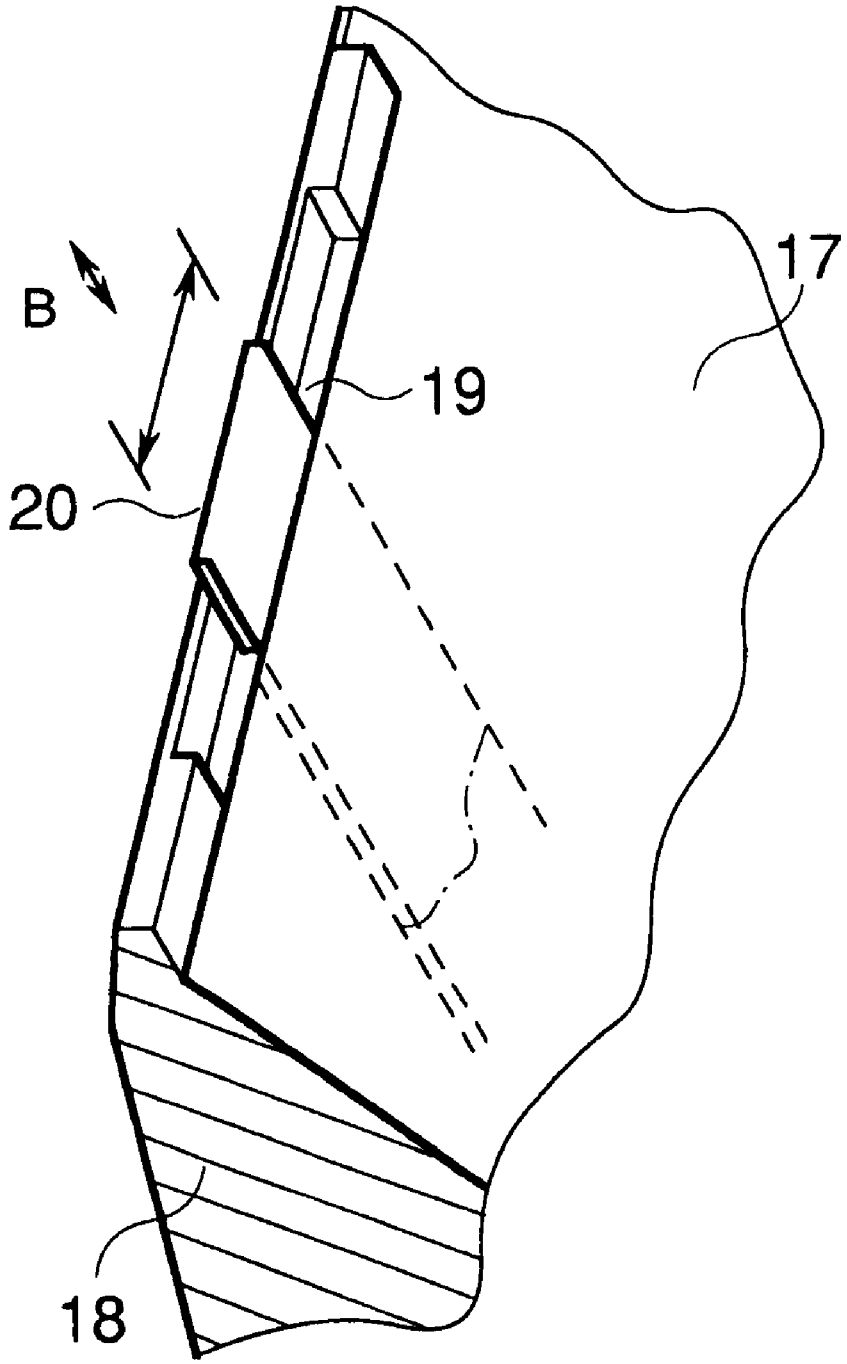
FIG. 9 is a fragmentary perspective view with a partially cross-sectional side view, of a paper feeding mechanism 16 according to the fourth embodiment.

FIG. 6 is a partially cross-sectional side view of a paper feeding mechanism 16 according to a fourth embodiment. FIG. 7 is an enlarged partially cross-sectional side view of a relevant portion. FIG. 8 is an expanded partially cross-sectional view of a plate 20. FIG. 9 is a perspective view of the plate and its surroundings.

A thick body portion 18 is formed with a hole 19 therein through which the flexible plate 20 slidably moves in a direction shown by arrow B within the hole 19 toward and away from the paper pick-up roller 4 as shown in FIG. 9. The hole 19 is just wide enough for the plate 20 to slide therethrough. The plate 20 is located in a longitudinal direction substantially at a center of the paper pick-up roller and extends over a distance of about 20 mm along the length of the paper pick-up roller 4. The plate 20 has a T-shaped end 20*a* which is urged by a spring 21. The plate 20 has a free end portion 20*b* which is rounded at 20*e* as shown in FIG. 7 and an end surface 20*d*. The plate 20 is urged by the spring 21 against the paper pick-up roller 4 so that the free end surface 20*d* is in pressure contact with the paper pick-up roller 4. The pressure is adjusted to be about ten grams. The rest of the construction is the same as that of the first embodiment.

The operation of the fourth embodiment will be described.

The plate 20 is in contact with the paper pick-up roller 4 just before the print paper 2 is loaded into the tray 3. The plate 20 blocks the print paper 2 so that the print paper 2 will not enter a gap d between the thick body portion 18 and the paper pick-up roller 4. If a stack of pages of print paper 2, which is as thick as a gap d between the paper pick-up roller 4 and the tip of the thick body portion 18, is inserted into the tray 3 through a paper feeding area 9, the plate 20 abuts the stack of pages to prevent the stack of print paper 2 from entering the gap d.

When the paper pick-up roller 4 starts to rotate in the direction shown by arrow A, the pick-up roller 4 will feed the top page 2*a*. The top page 2*a* will drag some pages immediately under the top page 2*a* due to friction between the top page 2*a* and the pages thereunder. When the paper pick-up roller 4 further rotates, the rounded corner 20*e* of the end portion 20*b* of the plate 20 facilitates the entering of the print paper 2 between the plate 20 and the paper pick-up roller 4. Thus, as shown in FIG. 8, only the top page 2*a* is advanced toward the separator 5 as the paper pick-up roller 4 further rotates, pressing down the plate 20 a distance equal to the thickness of the paper against the urging force of the spring 21. The radius of curvature of the rounded corner 20*e* is between 0.1 mm and 0.3 mm, so that only one or few pages at most are allowed to enter a small space defined by the paper pick-up roller 4 and the rounded corner 20*e* of the free end portion 20*b*.

Even if more than one page passes beyond the plate 20, the top page will be separated from the rest by the separator 5.

The fourth embodiment prevents a plurality of pages from being fed out of the tray 3 at a time. This provides further advantages as follows: It is ensured that print paper 2 is fed page by page from the tray 3. This eliminates an excessive load on the paper feeding mechanism (the paper pick-up roller 4 and separator 5). Secondly, pages of print paper 2 are prevented from jamming and are fed at a uniform speed since the construction eliminates the possibility of an excessive load being exerted on the paper feeding mechanism. Thirdly, the plate 20 is in pressure contact with the paper pick-up roller 4, applying a pressure of about ten grams. Further, the plate 20 is adapted to move away from the paper pick-up roller 4 against an urging force of the spring 21. The combination of paper pick-up roller 4 and the plate 20 allows the print paper 2 to be smoothly fed out of the tray 3 one page at a time without regard to the thickness of the print paper 2.

The fourth embodiment effectively solves the problem that once more than one page has entered a narrow area between the paper pick-up roller 4 and the tray 3, the separator 5 is unable to separate the top page 2*a* from the other pages. The fourth embodiment also overcomes a problem that if the separation of a page is not ensured, the paper pick-up roller 4 may be subjected to too heavy a load when it starts to rotate, failing to feed any print paper 2.

Fifth Embodiment

Figure 10:
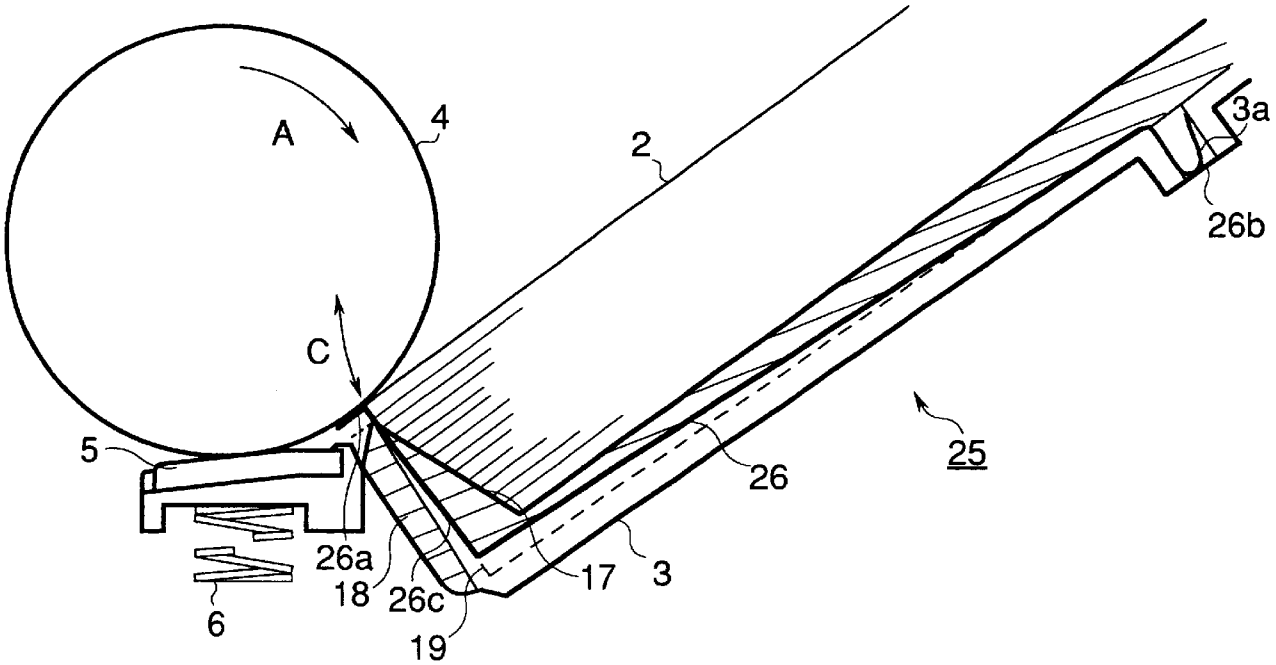
FIG. 10 is a partially cross-sectional side view of a paper feeding mechanism 25 according to a fifth embodiment.
Figure 11:
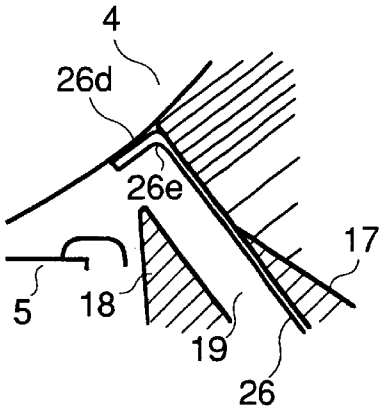
FIG. 11 illustrates a relevant portion of FIG. 10.

FIG. 10 is a partially cross-sectional side view of a paper feeding mechanism 25 according to a fifth embodiment. The fifth embodiment differs from the fourth embodiment in that a flat spring 26 is used in place of the plate 20 and spring 21. The rest of the construction is the same as the fourth embodiment. The flat spring 26 flexes, so that a free end portion 26*a* of the flat spring 26 is movable in a direction shown by arrow C, moving toward or away from the paper pick-up roller 4. When the flat spring 26 is fully pressed down by the print paper 2, it takes up a dotted line position. The free end portion 26*a* is usually in pressure contact with the paper pick-up roller 4. As shown in FIG. 11, the free end portion 26*a* is bent into an L-shape at about 1.5 mm from the tip so as not to interfere the passage of the print paper 2. The radius of curvature of the bent corner is between 0.1 mm and 0.3 mm. The end 26*b* is of a hook-like shape and is trapped in a recess 3*a* in the tray 3 which in turn holds the end 26*b* in position. The flat spring 26 applies a pressure of about ten grams to the paper pick-up roller 4. A portion 26*c* is at an angle of about 90 degrees with the direction in which the print paper 2 is fed out of the tray 3. The portion 26*c* is guided in the hole 19 formed in the thick body portion 18.

Figure 12:
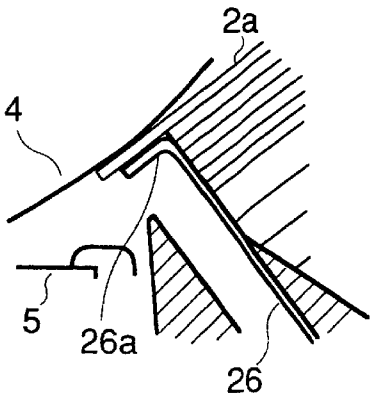
FIG. 12 is an expanded partially cross-sectional side view of a relevant portion of FIG. 10.

FIG. 12 is an expanded partially cross-sectional view of the flat spring 26. When the paper pick-up roller 4 further rotates, the rounded corner 26*e* of the flat spring 26 facilitates the (entering of the) print paper 2 into a gap formed between the flat spring 26 and the paper pick-up roller 4. Thus, as shown in FIG. 12, only the top page 2*a* is advanced toward the separator 5 as the paper pick-up roller 4 further rotates, pressing down the flat spring 26 a distance equal to the thickness of the paper against the urging force of the flat spring 26. The radius of curvature of the corner 26*e* is between 0.1 mm and 0.3 mm, so that only one or few pages at most are allowed to enter a small space defined between the paper pick-up roller 4 and the rounded corner 26*e* of the flat spring 26.

The construction of the fifth embodiment operates as follows: When a stack of print paper 2 has been loaded into the tray 3, the leading end of a part of the stack of print paper 2 abuts the end portion 26*a* of the flat spring 26. When the paper pick-up roller 4 is rotated, the top page 2*a* pushes down the flat spring 26 against the urging force of the flat spring 26, creating a very narrow gap between the end surface 26*d* and the paper pick-up roller 4. The top page 2*a* passes through this narrow gap to the separator 5. The dotted line position in FIG. 10 shows the flat spring 26 when it is pushed down by a maximum distance.

The construction of the fifth embodiment further reduces the number of parts required in the fourth embodiment while still yielding the advantages of the fourth embodiment. The flat spring 26 is located substantially within the tray 3, and therefore does not require any additional space.

Sixth Embodiment

Figure 13:
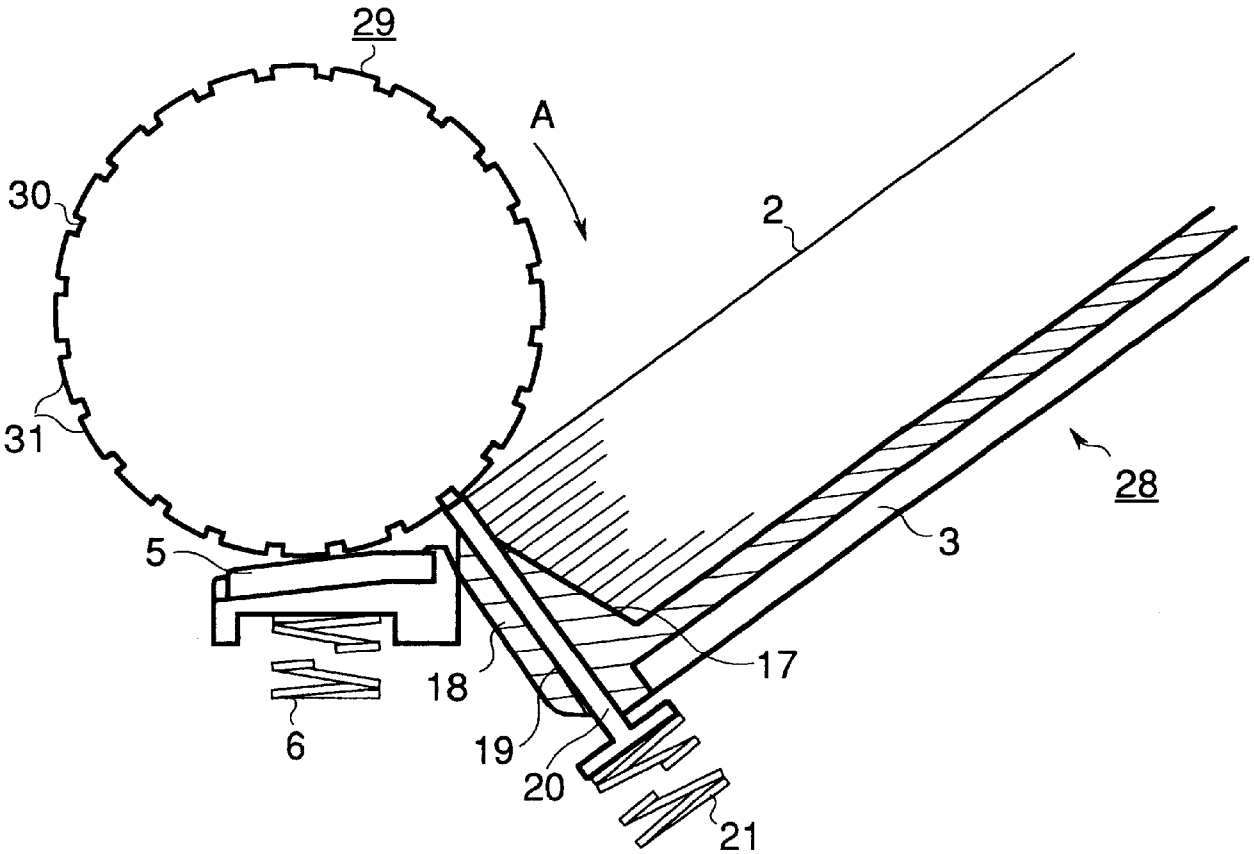
FIG. 13 is a partially cross-sectional side view of a paper feeding mechanism 28 according to a sixth embodiment.
Figure 14:
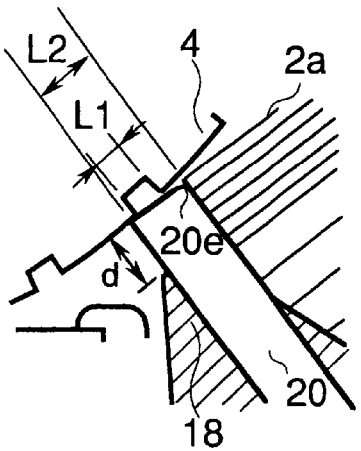
FIG. 14 illustrates a relevant portion of FIG. 13.

FIG. 13 is a partially cross-sectional side view of a paper feeding mechanism 28 according to a sixth embodiment. FIG. 14 illustrates a relevant portion of FIG. 13. The sixth embodiment differs from the fourth embodiment in that the paper pick-up roller 29 is knurled. The paper pick-up roller 29 is formed with grooves 30 in its surface at predetermined intervals. The grooves 30 run along the length of the paper pick-up roller 29. As shown in FIG. 14, the width L1 of the groove 30 is smaller than the thickness L2 of the tip portion of the plate 20, so that the tip of the plate 20 will not drop into the groove 30. The widths L1 and L2 are about 0.8 mm and 1.5 mm, respectively. The rest of the construction of the sixth embodiment is the same as that of the fourth embodiment.

The paper feeding mechanism 28 of the sixth embodiment operates in much the same way as the paper feeding mechanism 16 of the fourth embodiment. The grooves 30 formed in the surface of the paper pick-up roller 29 accept paper particles deposited on the roller surface, preventing the friction between the paper pick-up roller 29 and the print paper 2 from decreasing. Thus, the friction may be maintained substantially the same. The grooves 30 provide the paper pick-up roller 4 with a rough surface. The corners of ridges 31 firmly engage the paper to "hold" the print paper 2, increasing the friction between the print paper 2 and the paper pick-up roller 29 to ensure the advancement of the travel of the print paper 2 from the tray 3. Since no part of the tip of the plate 20 enters the groove 30, the plate 20 does not interfere with the rotation of the paper pick-up roller 4, and the engagement between the paper pick-up roller 29 and the plate 20 makes no abnormal sounds when the paper pick-up roller 29 rotates.

Seventh Embodiment

Figure 15:
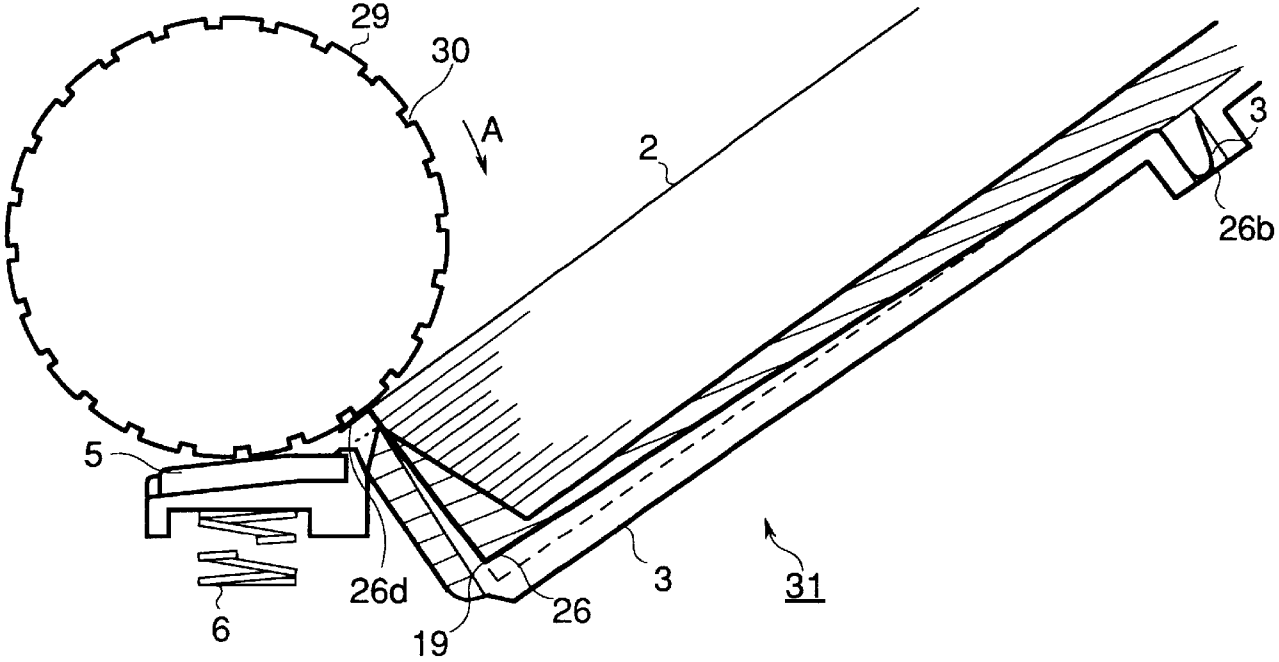
FIG. 15 is a partially cross-sectional side view of a paper feeding mechanism 31 according to a seventh embodiment.
Figure 16:
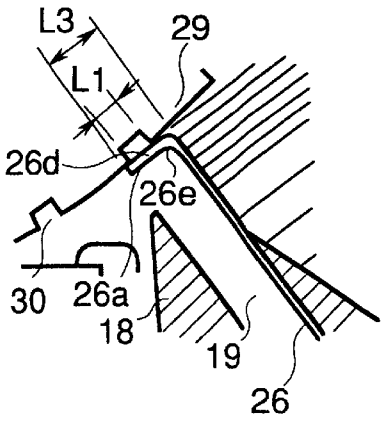
FIG. 16 is a partially cross-sectional side view of a relevant portion of FIG. 15.

FIG. 15 is a partially cross-sectional side view of a paper feeding mechanism 31 according to a seventh embodiment. FIG. 16 is a partially cross-sectional side view of a relevant portion of FIG. 15. The seventh embodiment differs from the fifth embodiment in that the paper pick-up roller 29 is knurled. The paper pick-up roller 29 is formed with grooves 30 in its surface at predetermined intervals. The grooves 30 run along the length of the paper pick-up roller 29. As shown in FIG. 16, the width L1 of the groove 30 is smaller than the width L3 of the bent tip portion of the flat spring 26, so that an end surface 26*d* of the flat spring 26 will slide on the paper pick-up roller 29 but will not drop into the groove 30. The width L3 is about 1.5 mm. The rest of the construction of the seventh embodiment is the same as that of the fifth embodiment.

The paper feeding mechanism 31 of the seventh embodiment operates in much the same way as the paper feeding mechanism 25 of the fifth embodiment. The corners of the ridges 31 catch and strongly hold the print paper 2 between the paper-pick-up roller 29 and the flat spring 20, increasing the friction between the print paper 2 and the flat spring 26, thereby ensuring feeding of the print paper 2. As is clear from FIG. 16, no part of the flat spring 26 engages the groove 30, and therefore the rotation of the paper pick-up roller 29, the flat spring 26 does not interfere with or makes no abnormal sounds.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A paper feeding mechanism, comprising:

a rotatable paper pick-up roller which frictionally engages a top page of a stack of print paper; and a paper tray which holds the stack of print paper, the paper pick-up roller feeding the print paper out of the paper tray into a paper path when the paper pick-up roller is rotated, with the print paper being advanced one page at a time, said paper tray comprising:

a first surface forming a downgrade with respect to a horizontal plane, said first surface being at a first angle with the horizontal plane so that when the print paper is placed on said first surface, a weight of the print paper causes the print paper to slide down said first surface; and a second surface extending between a lower end of said first surface and the paper pick-up roller, said second surface having a first end connected to the lower end of said first surface and a second end adjacent to said pick-up roller, the second end of said second surface being higher than the first end of said second surface with respect to the horizontal plane, said second surface being at a second angle with the horizontal plane, the second angle being smaller than the first angle so that the weight of the print paper causes a leading end of the print paper to slide up the second surface to the pick-up roller;

wherein when the stack of print paper is placed on said first surface, the stack of print paper slides down toward said second surface, and then at least the top page of the stack of print paper is guided by said second surface into pressure contact with the paper pick up roller.

2. The paper feeding mechanism according to claim 1, wherein said first angle is less than 36 degrees.

3. The paper feeding mechanism according to claim 1, further including an urging member positioned against a rear surface of the print paper, and at a lower end portion thereof, said urging member urging the print paper against the paper pick-up roller.

4. The paper feeding mechanism according to claim 1, wherein said first surface and said second surface are contiguously connected together.

5. The paper feeding mechanism according to claim 1, further including:

a separator in contact with the paper pick-up roller; and a plate placed upstream of said separator with respect to the direction of travel of the print paper and operating independently of said separator, said plate having:

a rounded corner on which a lower end of the print paper, guided by said second surface, slides into contact with the paper pick-up roller; and an end surface urged against the paper pick-up roller, said plate being movable relative to the paper pick-up roller so that said end surface moves away and toward the paper pick-up roller, said end surface moving out of contact engagement with the paper pick-up roller when the paper pick-up roller rotates and the print paper is pulled in between the paper pick-up roller and said end surface, said end surface moving into contact engagement with the paper pick-up roller when the paper pick-up roller stops rotating after the print paper has passed between the paper pick-up roller and said end surface.

6. The paper feeding mechanism according to claim 5, further including a biasing member which urges said plate against the paper pick-up roller so that said end surface of said plate is in pressure contact with the paper pick-up roller.

7. The paper feeding mechanism according to claim 6, wherein the paper pick-up roller is formed with a plurality of grooves in its surface, said grooves extending along a length of said paper pick-up roller, and said end surface of said plate sliding on the surface of the said paper-pick-up roller when the paper pick-up roller rotates.

8. The paper feeding mechanism according to claim 1, further including:

a separator in contact with the paper pick-up roller; and a flat spring placed upstream of said separator with respect to the direction of travel of the print paper and operating independently of said separator, said flat spring having:

a rounded corner on which a lower end of the print paper, guided by said second surface, slides into contact with the paper pick-up roller; and an end surface urged against the paper pick-up roller, said flat spring being movable relative to the paper pick-up roller so that said end surface moves away and toward the paper pick-up roller, said end surface moving out of contact engagement with the paper pick-up roller when the paper pick-up roller rotates and the print paper is pulled in between the paper pick-up roller and said end surface, said end surface moving into contact engagement with the paper pick-up roller when the paper pick-up roller stops rotating after the print paper has passed between the paper pick-up roller and said end surface.

9. The paper feeding mechanism according to claim 8, wherein the paper pick-up roller is formed with a plurality of grooves in its surface, said grooves extending along a length of said paper pick-up roller, and said end surface of said flat spring sliding on the surface of said paper pick-up roller when the paper pick-up roller rotates.

* * * * *